US005826858A

United States Patent [19]

Gordon

[11] Patent Number: 5,826,858

[45] Date of Patent: Oct. 27, 1998

[54] CARPENTRY TOOL

[76] Inventor: Robert A. Gordon, 109 Hilhurst La., Rochester, N.Y. 14617

[21] Appl. No.: 761,501

[22] Filed: Dec. 6, 1996

Related U.S. Application Data

[60] Provisional application No. 60/009,232 Dec. 26, 1995.

[51] Int. Cl.[6] ..... B66F 3/00

[52] U.S. Cl. ..... 254/17

[58] Field of Search ..... 254/11–17; 269/236

[56] References Cited

U.S. PATENT DOCUMENTS

| | | | |
|---|---|---|---|
| 77,610 | 5/1868 | Hall . | |
| 338,933 | 3/1886 | Cloyd . | |
| 342,529 | 5/1886 | McRae . | |
| 371,169 | 10/1887 | Brown et al. | 254/15 |
| 607,567 | 7/1898 | Jordan . | |
| 668,573 | 2/1901 | Bleach . | |
| 796,134 | 8/1905 | LeRoy . | |
| 829,946 | 9/1906 | Buff . | |
| 863,373 | 8/1907 | Fraker . | |
| 1,060,843 | 5/1913 | Huston . | |
| 2,438,766 | 3/1948 | Rifenberg . | |
| 2,624,544 | 1/1953 | Graham . | |
| 2,718,374 | 9/1955 | Kellenbarger . | |
| 4,821,784 | 4/1989 | Cone . | |
| 5,248,127 | 9/1993 | Young . | |
| 5,269,494 | 12/1993 | Pittman et al. . | |
| 5,478,050 | 12/1995 | Ott | 254/17 |
| 5,605,319 | 2/1997 | Reiley | 254/17 |

*Primary Examiner*—Robert C. Watson

*Attorney, Agent, or Firm*—Nixon, Hargrave, Devans & Doyle LLP

[57] ABSTRACT

A carpentry tool for pushing flooring boards into contact on a joist can be operated with one hand, leaving the carpenter's other hand free for hammering. The tool includes a body member having offset clamping lugs for engaging each side of a joist. A cam lever pivotally mounted at one end of the body member is adapted to force a cam thereon into pushing contact with a flooring board supported by the joist.

5 Claims, 7 Drawing Sheets

CARPENTRY TOOL

RELATED APPLICATIONS

This application claims the benefit of U.S. Provisional Patent Application Serial No. 60/009,232 filed Dec. 26, 1995.

FIELD OF THE INVENTION

This invention relates to a carpentry tool and, more particularly, to a tool for pushing parallel boards together in flooring or other structures.

BACKGROUND

Various tools have been used for pushing deck or flooring boards and the like into parallel contact before nailing the boards to a joist. Examples of such tools are disclosed in U.S. Pat. Nos. 5,248,127 and 5,269,494 and in the prior art references cited therein. The tools of the prior art have various drawbacks. Most require the carpenter to use both hands to operate the tool and an assistant has to nail the boards to the supporting joist. The tool of U.S. Pat. No. 5,269,494 requires the carpenter to rotate a locking lever in order to engage the tool with a floor joist before floor boards can be pushed into place. Most are undesirably complex and expensive. A need exists for a simple, inexpensive flooring tool that can be operated with one hand. The present invention provides such a tool.

BRIEF SUMMARY OF THE INVENTION

The device of the invention comprises an elongated body member having upper and lower flat faces. At or near one end of the upper face is a pivot means. At or near the other end of the body member a first clamping lug extends from the lower face. A second clamping lug extends from the lower face at a position between the pivot means and the first clamping lug. The first and second clamping lugs have flat inner faces that are parallel along lines substantially distant from each other to enable said lugs to engage opposite vertical sides of a flooring joist. Each lug, on its side facing toward the other lug, has an edge for engaging one vertical side of a joist on which the body member rests. A cam lever having a handle end and a pivot end is positioned at its pivot end in engagement with the pivot means of the body member. Extending from the cam lever at or near the pivot end is a cam means for applying force against a board resting on the joist when the cam lever is rotated about the pivot means, the cam member being on the same side of the body member as the lug at the opposite end of the body member.

DRAWINGS

The invention will be described in more detail by reference to the drawings, of which:

DETAILED DESCRIPTION

The present invention provides a novel tool as a useful and convenient means for pushing boards together when building decks or putting in sub-flooring over joists. It can also be used for pushing plywood sheets tightly together as for house framing and underlayments for roofs and for other purposes.

The boards, plywood or other materials, do not necessarily have to be 90° to the supporting joist when they are being pushed by this tool. Any divergent angle of overlay on a joist, stringer or stud can be accommodated.

Figure 1:
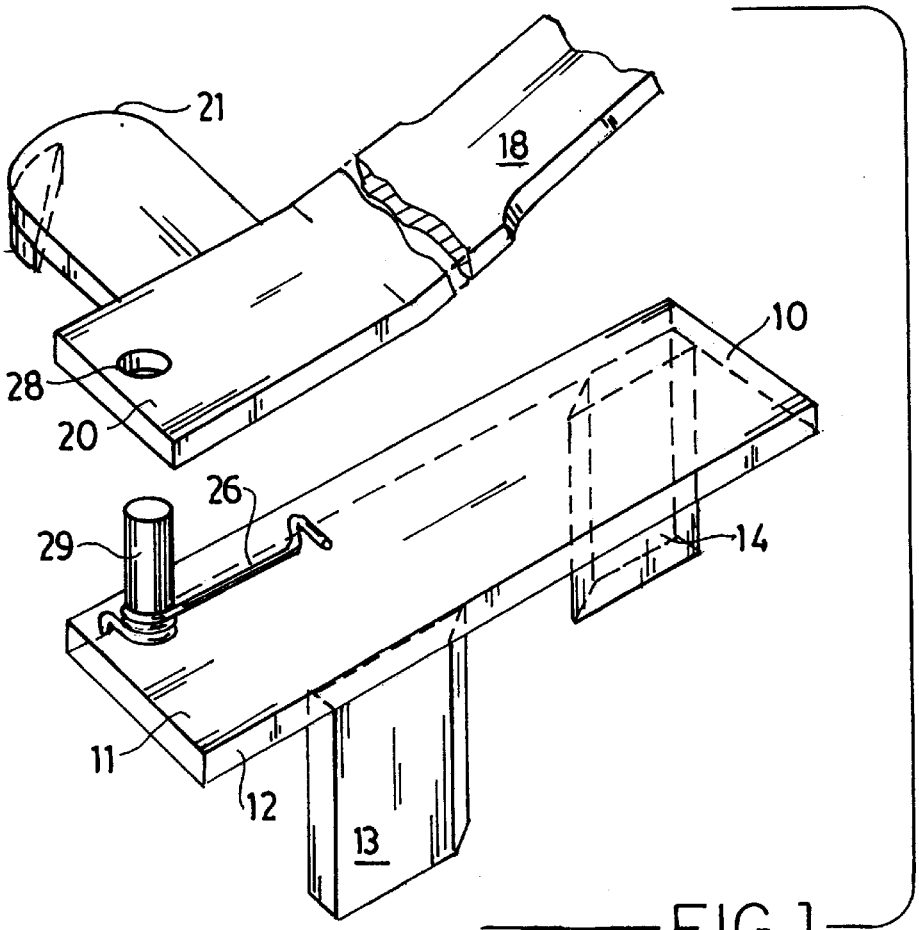
FIG. 1 is a schematic view, in perspective with parts broken away, of one embodiment of the tool of the invention.
Figure 3:
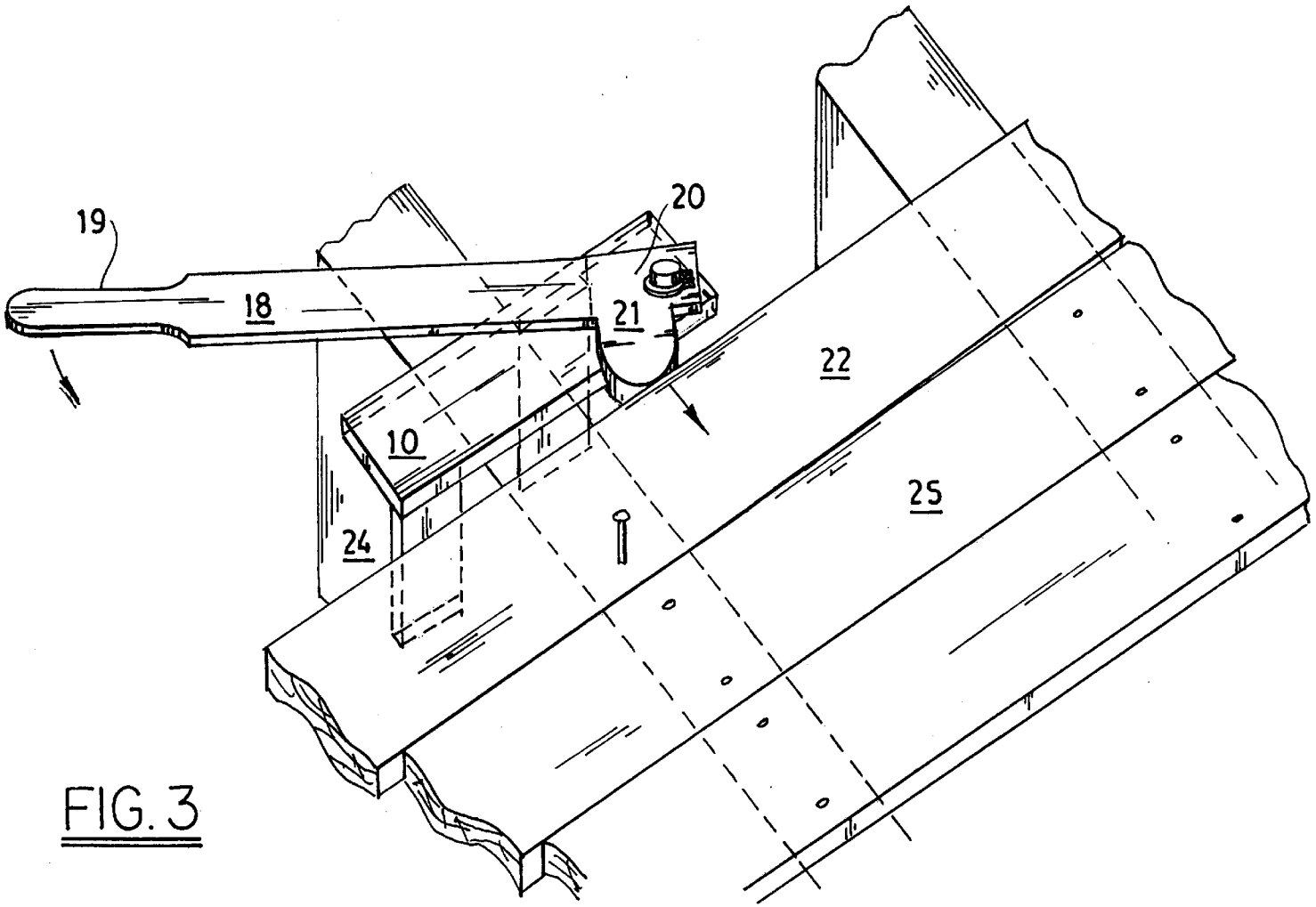
FIG. 3 is a schematic view of the embodiment of FIG. 1 showing the tool positioned on a joist and in engagement with a deck board.

As shown in FIGS. 1 and 3, the elongated body member 10, which preferably is formed of steel, has a flat upper face 11 and a parallel flat lower face 12. Two lugs 13 and 14 extend downwardly from the lower face of body member 10. The lugs 13 and 14 straddle a joist 24 which supports the tool, as shown in FIG. 3. A cam lever 18 has a handle end 19 and a cam end 20. At the cam end is camming means 21. Near the cam end 20 the cam lever 18 has a pivot means, such as aperture 28. The latter is adapted to engage a cooperating pivot means of the body member, such as vertical pin 29 which extends upwardly from body member 10 at the end opposite from lug 14. As shown in FIG. 3, lever 18 is pulled or pushed pivotally to bring cam 21 into contact with the deck board 22 to be pushed.

Figure 1A:
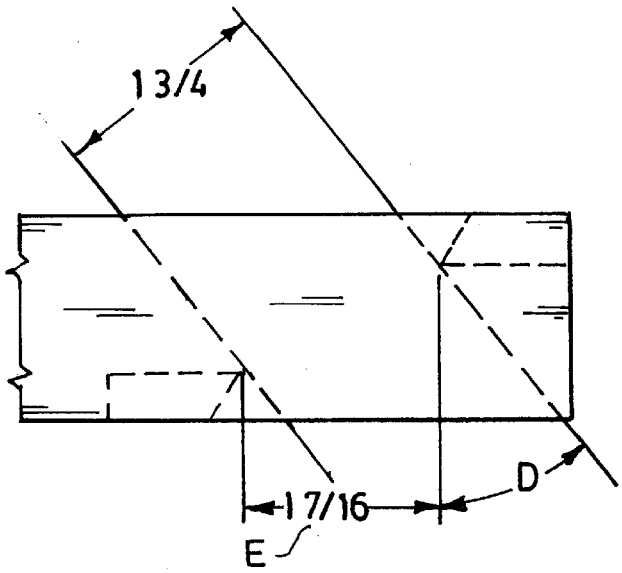
FIG. 1A is a detailed view of a portion of the body member of the tool showing dimensions between edges of clamping lugs of the tool.

Construction lumber for framing houses and decks, and a multitude of other things, generally runs in thickness from 1 7/16" to 1 ¾" thick. The two lugs 13 and 14, when dropped over the thickness section of a joist will accommodate these common dimensions and others. This is accomplished by virtue of the separation of the two lugs at dimension "E" as shown in FIG. 1A. When the body member is placed perpendicularly on a joist they are separated by dimension E which can be, for example 1 7/16". If canted at an angle "D" the lugs are, for example, 1 ¾" apart and can accommodate wider widths of lumber.

Figure 4:
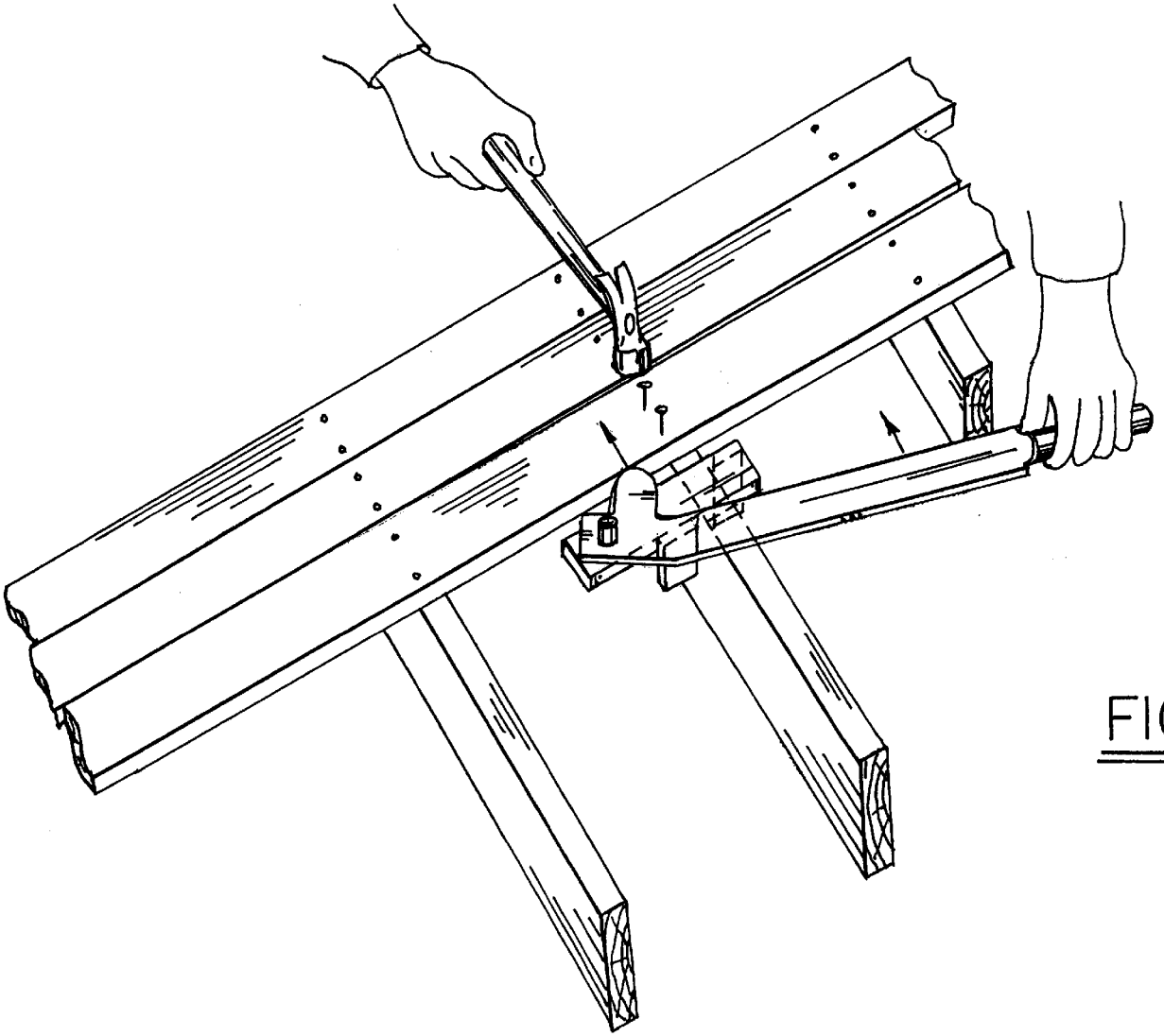
FIG. 4 is similar to FIG. 3 but shows the operation with one hand by a carpenter.
Figure 5:
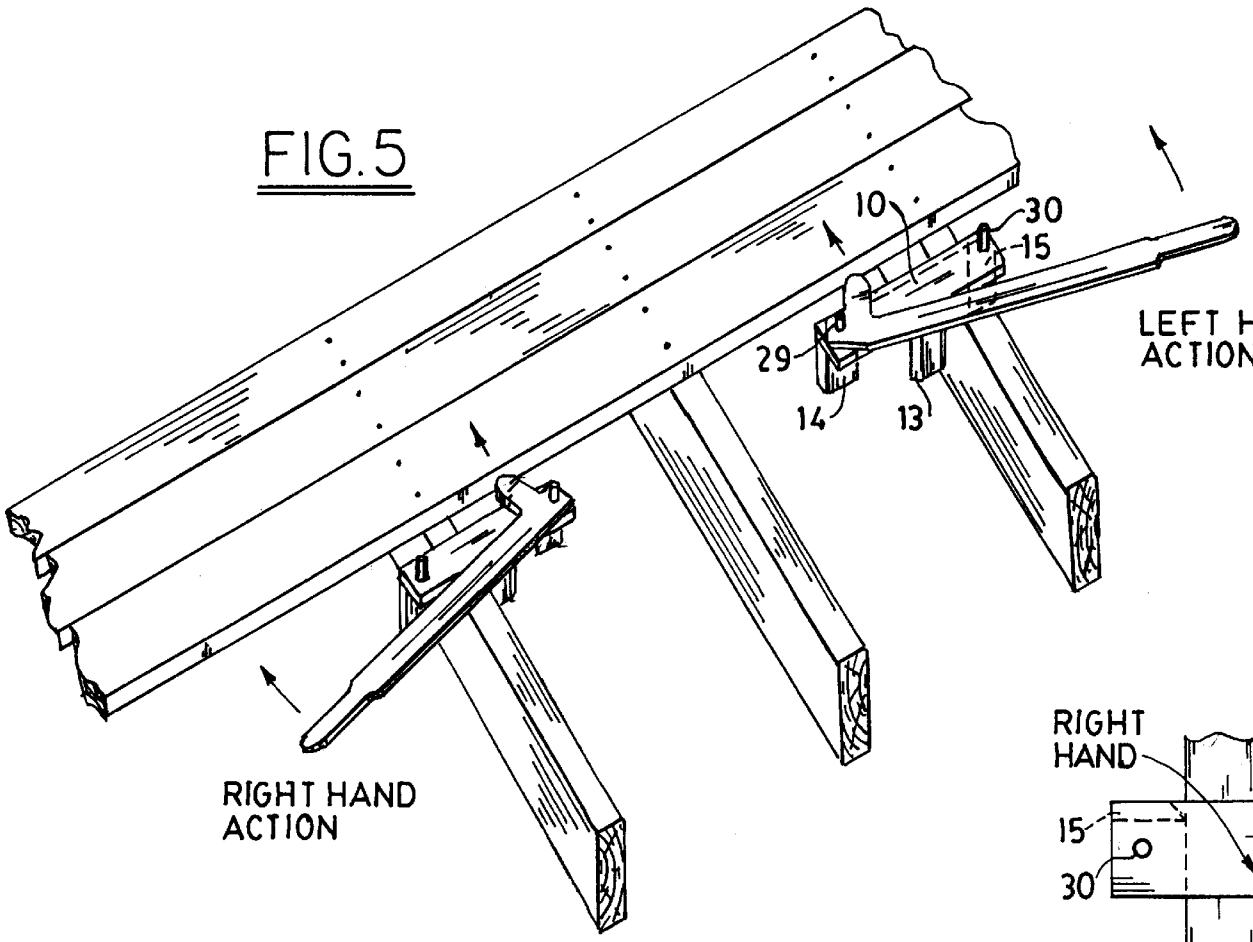
FIG. 5 shows an embodiment of the tool that can be positioned on a joist for either left hand or right hand use.
Figure 5A:
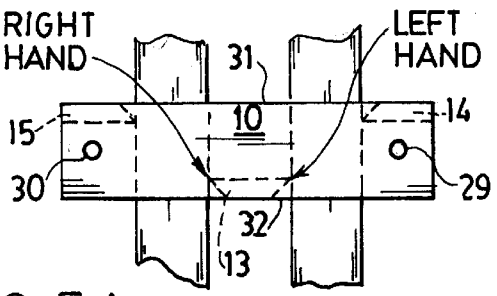
FIG. 5A shows details of a portion of the embodiment of FIG. 5.

The novel tool as shown in FIGS. 1, 3 and 4 is intended to be used in the left hand, leaving the right hand free to use a hammer for nailing or a screwdriver for driving screws. For a left hander the tool can be made in a mirror image to be held in the right hand. An embodiment of the tool that can be used either with the left or right hand is shown in FIG. 5. In this embodiment the body member 10 has three clamping lugs 13, 14, and 15 on its lower face and two pivot pins 29 and 30 on its upper face. Lugs 14 and 15 are at opposite ends of body member 10 and on the same longitudinal edge 31 thereof. The third lug 13 is on the opposite edge 32 and is positioned approximately midway between the ends of the body member.

Figure 2:
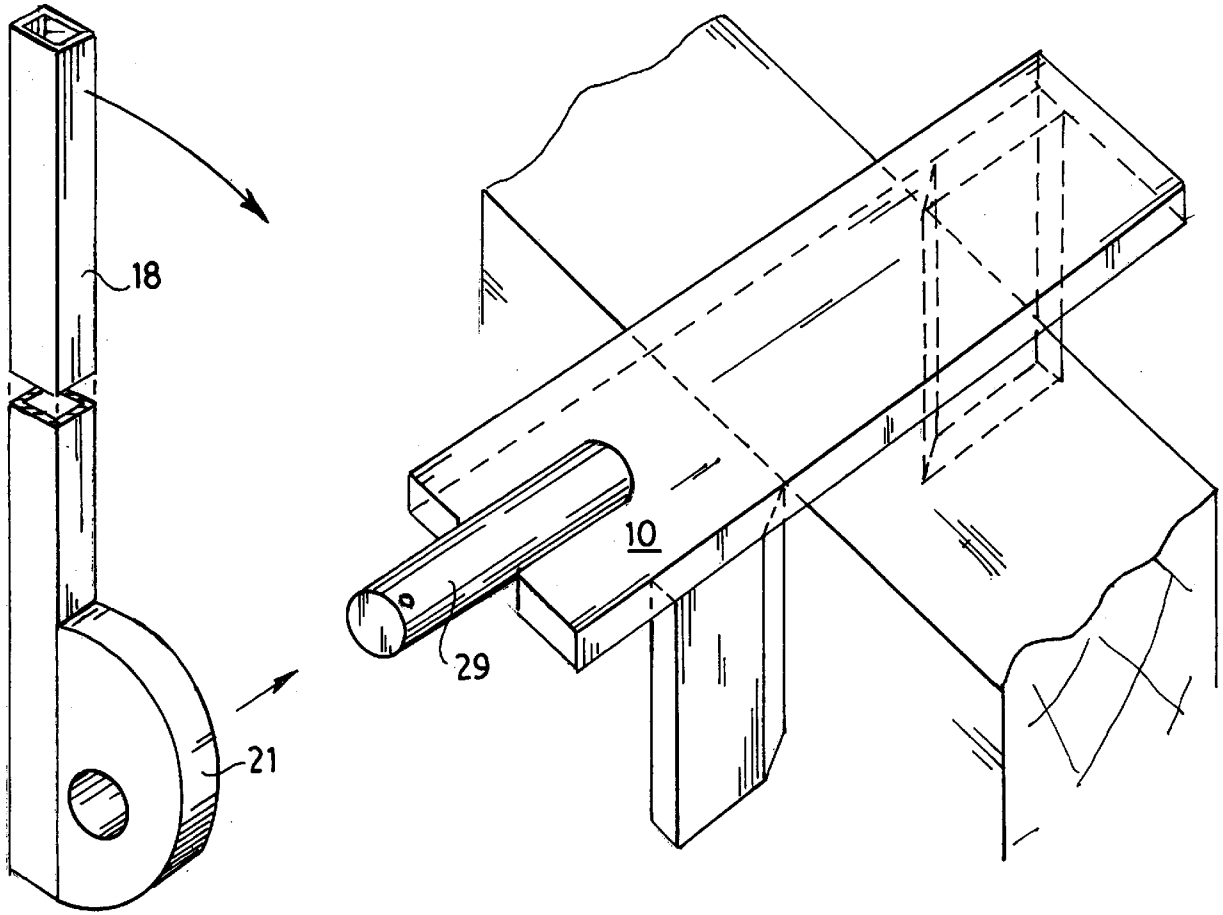
FIG. 2 is a view similar to FIG. 1 of another embodiment of the invention.
Figure 2A:
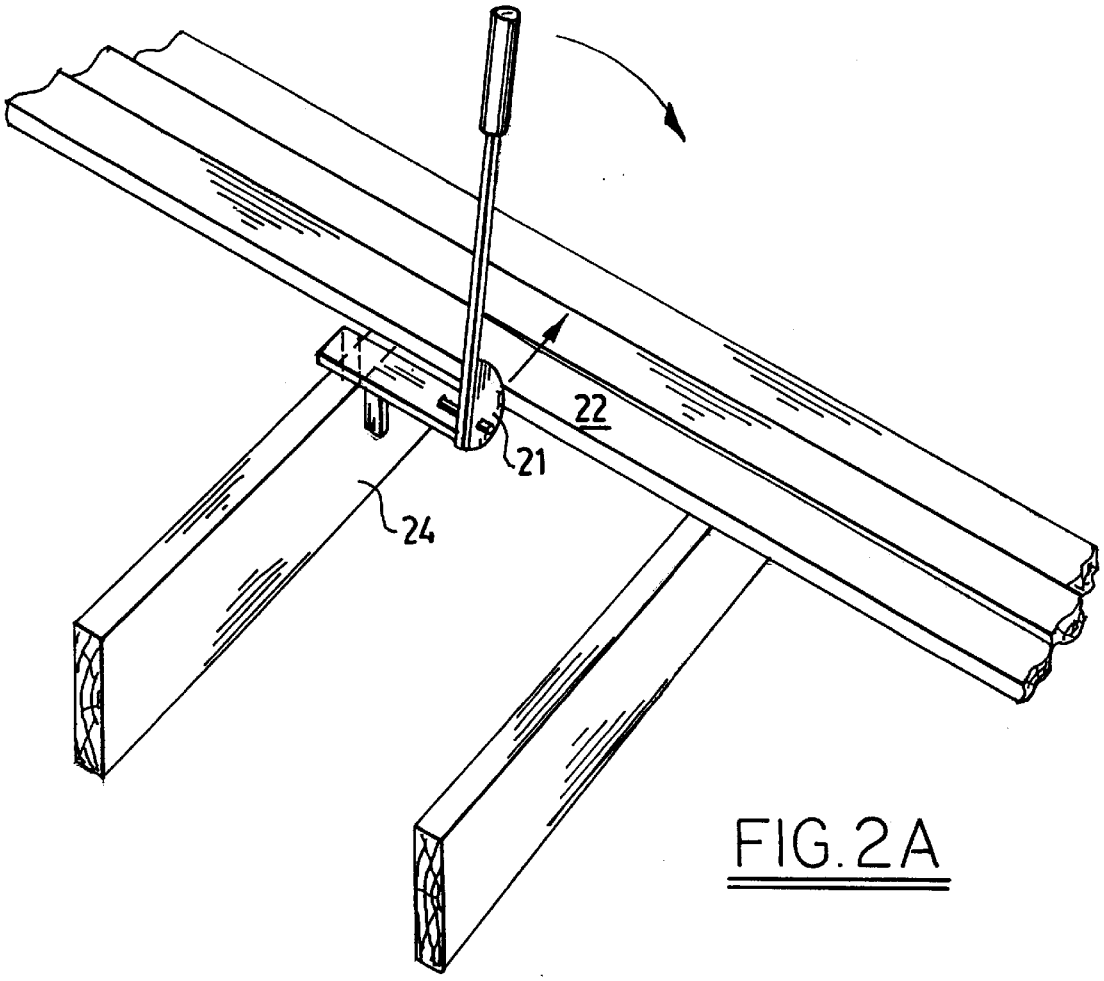
FIG. 2A shows the tool of FIG. 2 in use for pushing flooring boards on a joist.
Figure 2B:
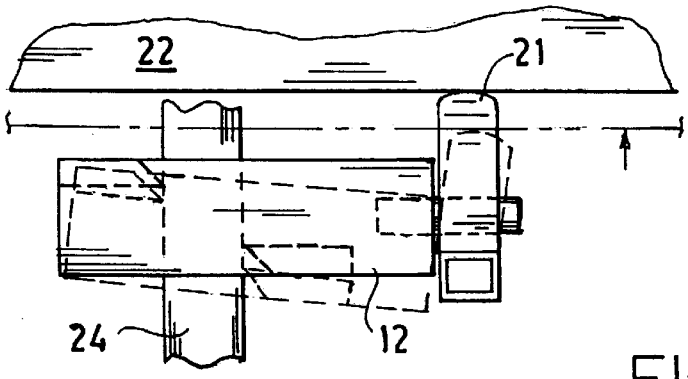
FIG. 2B is a detailed view of a portion of FIG. 2A.

FIG. 2 shows an embodiment of the invention in which the pivot means of body member 10 is a pin 29 extending longitudinally from the end of body member 10. FIG. 2A shows the tool of FIG. 2 positioned on a joist 24 for pushing a flooring board 22. As FIG. 2B shows, cam 21 in this embodiment, has a curved surface in order to present a curved surface to the edge of board 22. In dotted lines, FIG. 2B shows the canted position of the body member 10 when mounted on a thicker joist.

Use of the tool is as follows, with reference to FIG. 3:

Holding the tool in the left hand, the carpenter places the two lugs 13 and 14 over the joist 24 and slides the tool forward until the cam 21 is in contact with the board 22 to be pushed. A pull exerted on the lever 18 moves cam 21 against board 22 and forces it against the adjoining board 25. When a pull is exerted on the lever 18 the opposing force locks the lugs 13 and 14 into the joist to prevent slippage. As shown in FIG. 1, a coil spring 26 around pivot pin 29 is provided to return lever 18 and body member 10 back to a neutral position relative to each other so when the tool is used again it does not have to be reoriented.

Figure 6:
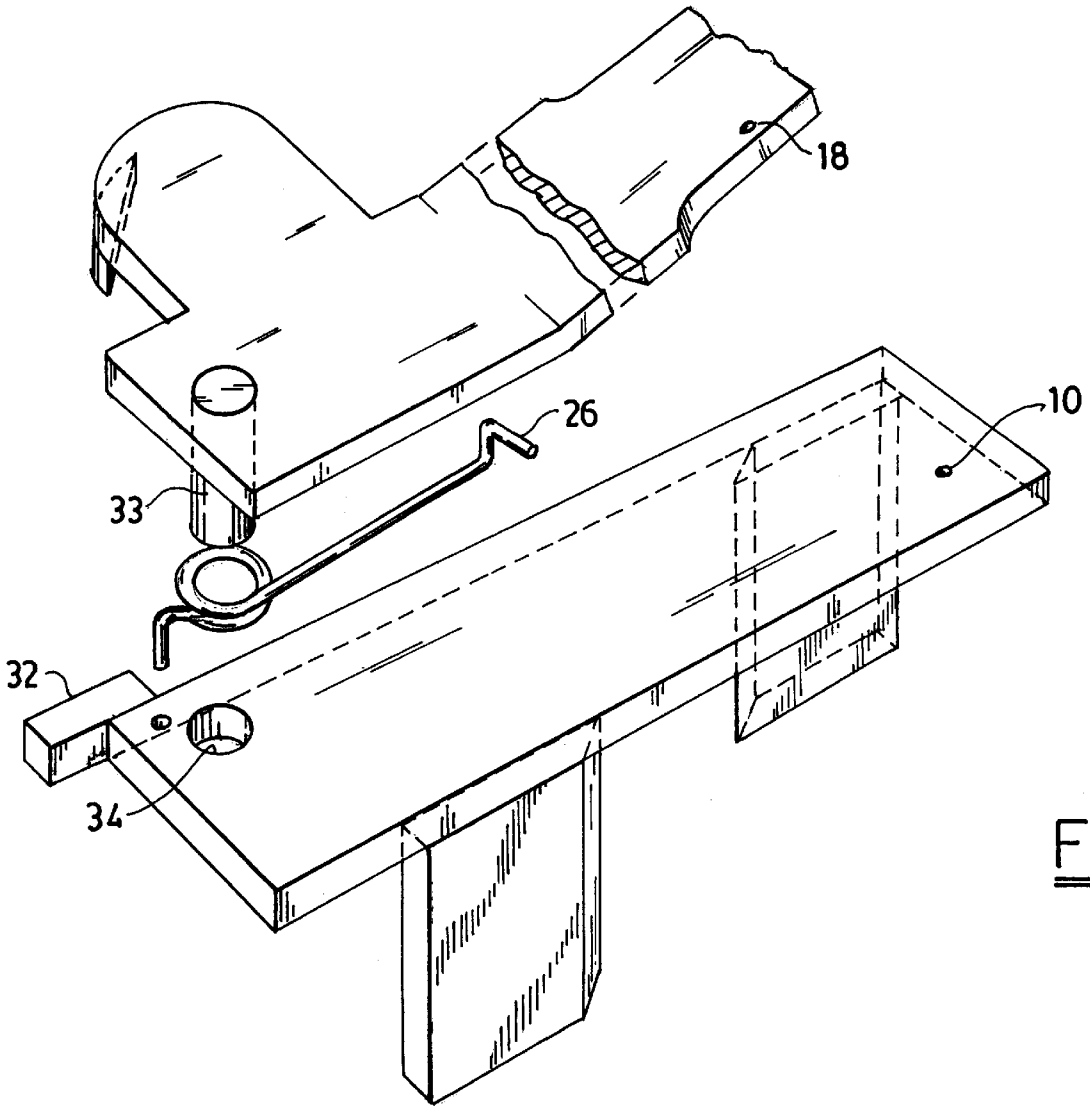
FIG. 6 is similar to FIG. 1 but additionally shows a stop means for limiting rotation of the cam lever and shows different pivot means.

In the embodiment of FIG. 6 a stop means 32 is welded to body member 10 near the pivot pin 29 to limit the rotation of the cam lever. The configurations of the cam lever and body member as shown in the drawings can be formed by welding or by casting.

The novel tool of the invention has numerous advantages. For example, because the lugs 13 and 14 are offset from each other, the tool can fit joists of different widths. It can fit a wide range of board sizes without need for readjustment to fit different sizes. The tool can be operated with one hand, leaving the carpenter's other hand free for hammering. In contrast, tools of the prior art normally require both hands to attach the tool to a joist before the pushing action begins. In the preferred embodiment of the present invention a means such as spring 26 returns the cam lever to its original position so that the carpenter can immediately reuse the tool. No locking lever is required to engage the lugs with the joist as in U.S. Pat. No. 5,269,494. As contrasted with the tool of U.S. Pat. No. 5,269,494, in the tool of the present invention the position of the pivot for the cam lever and the offset positioning of the lugs provide important advantages.

FIGS. 1–5 of the drawings show an embodiment of the invention in which the pivot means of the cam lever 18 is an aperture 28 and the pivot means of the body member 10 is a pin 29 which engages aperture 28. It should be understood that other pivot means can be used. For example, as shown in FIG. 6 a pivot pin 33 can be formed on the cam lever to engage an aperture 34 in the body member.

The invention has been described with particular reference to preferred embodiments thereof, but it will be understood that variations and modifications can be effected within the spirit and scope of the invention, and the foregoing description should be taken as illustrative and not in a limiting sense.

I claim:

1. A carpentry tool which comprises an elongated body member having upper and lower flat faces, a pivot means at or near one end of the upper face of the body member, three clamping lugs extending from the lower face, two of said lugs being at opposite ends of the body member and on the same longitudinal edge thereof, the third lug being one the opposite edge and positioned approximately midway between the ends of the body member said body member having pivot means at each end thereof on its upper face, a cam lever having a handle end and a cam end pivot means positioned at its cam end in engagement with one of the pivot means of the body member, extending from the cam lever at or near the cam end a cam means for applying force against a board resting on a joist when the cam lever is rotated about the pivot means.

2. A carpentry tool which comprises an elongated body member having upper and lower flat faces, a pivot means at or near one end of the upper face of the body member, at or near the other end of the body member a first clamping lug that extends from the lower face, a second clamping lug that extends from the lower face at a position between said pivot means and the first clamping lug, said first and second clamping lugs having flat inner faces that are parallel along lines substantially distant from each other to enable said lugs to engage opposite vertical sides of a flooring joist, each lug, on its side facing toward the other lug, having an edge for engaging one vertical side of a joist on which the body member can rest, a cam lever having a handle end and a cam end pivot means positioned at its cam end in engagement with the pivot means of the body member, extending from the cam lever at or near the cam end a cam means for applying force against a board resting on a joist when the cam lever is rotated about the pivot means, wherein a spring means associated with the pivot means of the body member is adapted to bias the cam lever in an opposite direction from a direction of rotation of the lever to apply force against a board resting on a joist.

3. The tool according to claim 1 adapted for right hand or left hand use wherein said body member has three clamping lugs extending from the lower face, two of said lugs being at opposite ends of the body member and on the same longitudinal edge thereof, the third lug being one the opposite edge and positioned approximately midway between the ends of the body member, and said body member having pivot means at each end thereof on its upper face.

4. The tool according to claim 1 wherein the first and second clamping lugs are permanently fixed to the elongated body member.

5. The tool according to claim 1 wherein the cam means extending from the cam lever at or near the cam end pivot means has a pivot position where the cam means extends out past a side edge of the elongated body member.

* * * * *